US010028553B1

(12) United States Patent
Hinkle

(10) Patent No.: US 10,028,553 B1
(45) Date of Patent: Jul. 24, 2018

(54) SPA COVER LATCH

(71) Applicant: John T. Hinkle, Roswell, NM (US)

(72) Inventor: John T. Hinkle, Roswell, NM (US)

( * ) Notice: Subject to any disclaimer, the term of this patent is extended or adjusted under 35 U.S.C. 154(b) by 0 days.

(21) Appl. No.: 15/372,889

(22) Filed: Dec. 8, 2016

Related U.S. Application Data

(60) Provisional application No. 62/264,761, filed on Dec. 8, 2015.

(51) Int. Cl.
*A44B 11/12* (2006.01)
*A44B 11/25* (2006.01)

(52) U.S. Cl.
CPC ..... *A44B 11/125* (2013.01); *A44B 11/2588* (2013.01)

(58) Field of Classification Search
CPC ..... A44B 11/125; A44B 11/2588; Y10T 24/45215; Y10T 24/4065; Y10T 24/4086
See application file for complete search history.

(56) References Cited

U.S. PATENT DOCUMENTS

| | | | | |
|---|---|---|---|---|
| 1,037,045 | A * | 8/1912 | Patton | A01K 13/008 24/667 |
| 1,852,506 | A * | 4/1932 | Dalton | A44B 11/28 24/578.14 |
| 4,399,594 | A * | 8/1983 | Ostermaier | A01K 13/008 24/194 |
| 5,604,958 | A * | 2/1997 | Anscher | A45C 7/0086 224/197 |
| 2006/0207072 | A1* | 9/2006 | Chen | A44B 11/2588 24/580.1 |

* cited by examiner

*Primary Examiner* — Robert Sandy
(74) *Attorney, Agent, or Firm* — Jeffrey D. Myers; Justin R. Jackson; Peacock Law P.C.

(57) ABSTRACT

A latch set and concomitant methods including an elongated receiving portion including an upper portion with a receiving slot at an angle from horizontal and at least one receiving hole on either side of the slot, and a lower portion with one or more attachment holes, and a strap engaging portion including a strap receiving slot, a channel going from an edge of the strap engaging portion to the strap receiving slot, and a portion engaging the elongated receiving portion via one or more inward-facing tabs on either side of a central connecting portion and configured to engage the one or more attachment holes.

14 Claims, 1 Drawing Sheet

SPA COVER LATCH

CROSS-REFERENCE TO RELATED APPLICATIONS

This application claims priority to and the benefit of the filing of U.S. Provisional Patent Application No. 62/264,761, filed on Dec. 8, 2015, and the specification thereof is incorporated herein by reference.

STATEMENT REGARDING FEDERALLY SPONSORED RESEARCH OR DEVELOPMENT

Not Applicable.

THE NAMES OF PARTIES TO A JOINT RESEARCH AGREEMENT

Not Applicable.

INCORPORATION BY REFERENCE OF MATERIAL SUBMITTED ON A COMPACT DISC

Not Applicable.

STATEMENT REGARDING PRIOR DISCLOSURES BY THE INVENTOR OR A JOINT INVENTOR

Not Applicable.

COPYRIGHTED MATERIAL

Not Applicable.

BACKGROUND OF THE INVENTION

Field of the Invention (Technical Field)

The present invention relates to spa cover latches and methods of using and making same.

Description of Related Art Including Information Disclosed Under 37 C.F.R. §§ 1.97 and 1.98:

Traditional spa cover latches are inadequate, being made of plastic, being sewn into straps, or both. These frequently break and are very difficult if not impossible to replace in situ. The present invention provides a durable and easy-to-use replacement latch that does not break and is easily incorporated into an existing strap.

BRIEF SUMMARY OF THE INVENTION

The present invention is of a latch set comprising: an elongated receiving portion comprising: an upper portion with a receiving slot at an angle from horizontal and at least one receiving hole on either side of the slot; and a lower portion with one or more attachment holes; and a strap engaging portion comprising: a strap receiving slot; a channel going from an edge of the strap engaging portion to the strap receiving slot; and a portion engaging the elongated receiving portion via one or more inward-facing tabs on either side of a central connecting portion and configured to engage the one or more attachment holes. In an embodiment, one or both ends of the elongated receiving portion are rounded. The attachment holes can number three and be placed in a triangular pattern. The portion engaging the elongated receiving portion can comprise a hole permitting gripping by fingers. The strap engaging portion can comprise one or more additional strap receiving slots, preferably two and preferably not having a channel going from an edge of the strap engaging portion thereto.

The present invention is also of a method of replacing an existing latch set with a latch set as above, comprising: removing the existing latch set from a strap; sliding the strap engaging portion onto the strap via the channel and the strap receiving slot to seat over and above a retainer point of the strap; inserting the portion engaging the elongated receiving portion into the receiving slot; rotating the portion engaging the elongated receiving portion to cause the one or more tabs to engage the one or more receiving holes; and attaching the elongated receiving portion to a surface using the one or more attachment holes to provide tension to the strap. The existing latch set can be for a spa cover.

The present invention is further of a method of installing a latch set as above, comprising: attaching a strap to the strap engaging portion via the channel and the strap receiving slot; inserting the portion engaging the elongated receiving portion into the receiving slot; rotating the portion engaging the elongated receiving portion to cause the one or more tabs to engage the one or more receiving holes; adjusting the strap length via the one or more additional strap receiving slots; and attaching the elongated receiving portion to a surface using the one or more attachment holes to provide tension to the strap. The existing latch set can be for a spa cover. The steps can be repeated for a second latch set and/or for an opposite end of the strap.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more embodiments of the invention and are not to be construed as limiting the invention. In the drawings.

DETAILED DESCRIPTION OF THE INVENTION

The present invention is of improved spa latches and methods of using and making same. One embodiment provides a replacement kit for all broken plastic spa cover hold down latches. A second embodiment is for the installation of wind straps (usually two). Note that there are two different preferred designs for the latches 10,20, but both can use the same receiver 30.

The invention is also useful to OEM spa cover manufacturers. A kit preferably contains four latches, four receivers, twelve screws, and an instruction sheet. This replaces the plastic latches that all cover manufacturers presently use. There are usually four one-inch wide vinyl loop spa cover hold-down straps on each cover. The four straps are typically located about one foot from each corner on opposite sides of the spa cover. The hold down straps and latches are there mainly to keep the wind from blowing the cover off of the spa when not occupied and in use.

Figure 1:
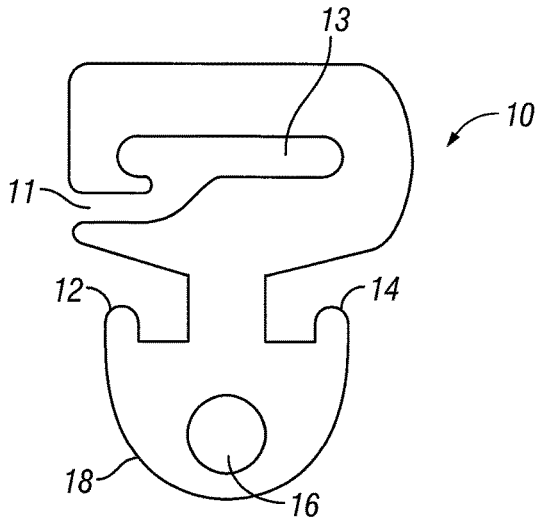
FIG. 1 is a schematic diagram of an embodiment of a strap engaging portion of a latch set according to the invention.
Figure 2:
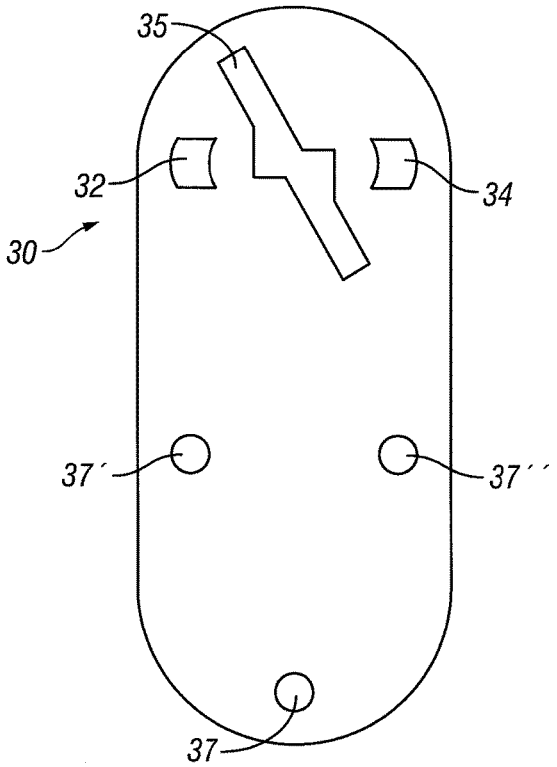
FIG. 2 is a schematic diagram of an embodiment of a receiving portion of a latch set according to the invention.
Figure 3:
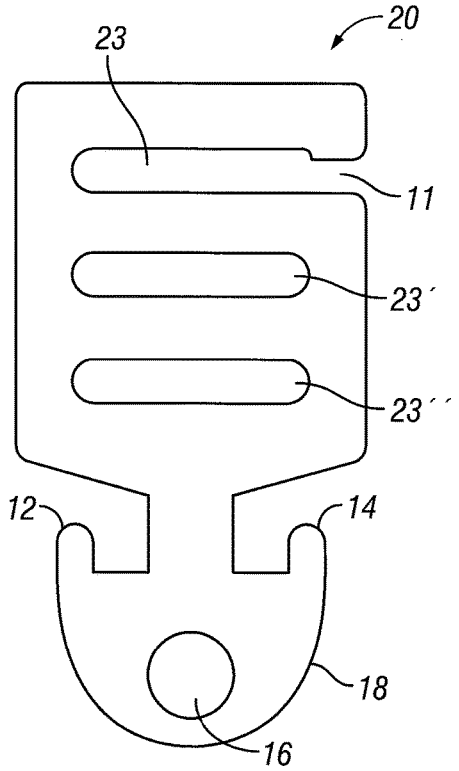
FIG. 3 is a schematic diagram of another embodiment of a strap engaging portion of a latch set according to the invention.

Referring to FIGS. 1 and 2, one improvement is the combination and manner that the latch 10, when on the spa cover strap, will engage the receiver 30 when it is screwed to the spa skirt side panels. Note that latch 10 comprises channel 11 leading to slot 13, which retains the spa cover strap. To some extent, the vinyl cover straps will naturally return from the 60 degree insertion angle preferred for retainer slot 35 to the parallel state, because the straps are sewn into the cover. Any movement of the spa cover will engage the two points 12,14 on the latch 10 into the corresponding slots 32,34 on the receiver 30. Preferably receiver 30 is bent at about its half-way point laterally, most preferably at an angle of about ninety degrees. Note attachment screw holes 37,37',37" preferred for the receiver 30.

Another improvement is the manner in which the latch 10 can be inserted (installed) over the spa cover strap to replace a broken plastic latch, without the need to cut the strap.

A third improvement is the ⅜" diameter hole 16 on the rounded tail 18 of the latch 10, which serves two purposes. One is to help the thumb and finger grip the latch 10 to pull it down into the locked position after insertion into retainer slot 35. Second, the hole 16 can be used to install a small padlock for added security. This may be required in jurisdictions such as California, mainly to keep small children out of the spa when no adults are in attendance.

The following steps are preferred in repairing a single strap of an existing spa cover installation:

(1) To replace an old or broken plastic spa cover hold down clip, use side cutting or regular pliers to cut or break off the old clip. Do not cut the vinyl spa cover strap. Remove the old plastic receiver screwed to the spa skirt and discard.

(2) Slide the new stainless steel latch onto the spa cover vinyl strap. Strap must be seated over and above the retainer point. Latch should hang at the bottom of the strap loop.

(3) Take "L" shaped receiver bracket and insert latch now on the strap into the slot at the 11:00-5:00 o'clock position. Note the down side/back position of the three attachment screw holes. Hold receiver bracket level and pull down on latch and rotate it counter-clockwise to 9:00-3:00 o'clock position. The two latch points will now seat into the two receiver slots.

(4) Hold receiver flat against spa skirt with just enough downward tension on the strap to fully engage latch points at all times. Install the center bottom screw. Check latch tension/position/operation several times by pulling down on the latch rounded tail, rotating and disengaging latch upward through slot. If OK, install the two top screws.

In reference to the wind strap latch embodiment 20, note that it uses the same receiver 30 as the spa cover latch 10. An important improvement is the open end third top slot 23. By slipping the straps out of the open slot 23, it makes it very easy to pull a loop out of the bottom two (or more) slots 23',23" to adjust the strap length. Reinsert the strap into the top slot 23, and it is very securely locked and will not slip.

The following steps are preferred in installing a pair of wind strap latches according to the invention:

(1) Determine the desired attachment locations on the spa skirt for the four "L" shaped receiver brackets. The wind strap placement usually runs parallel to the spa cover center fold and would visually and numerically divide the cover into three equal sections.

(2) Take "L" shaped receiver bracket and insert latch now on the strap into the slot at the 11:00-5:00 o'clock position. Note the down side/back position of the three attachment screw holes. Hold receiver bracket level and pull down on latch and rotate it counter-clockwise to 9:00-3:00 o'clock position. The two latch points will now seat into the two receiver slots. Adjust the strap length in latch if necessary to properly position height of bracket on the spa skirt.

(3) Hold receiver flat against spa skirt with just enough downward tension on the strap to fully engage latch points at all times. Install the center bottom screw. Check latch tension/position/operation several times by pulling down on the latch rounded tail, rotating and disengaging latch upward through slot. I OK, install the two top screws.

The three-slot latch design (or other plurality of slots) of the wind strap embodiment of the invention can be scaled up to use on 2" wide ratchet straps and also 4" wide straps in wide use by the trucking industry. The latch tail, of course, can be reshaped into a "J" hook or "C" shape depending on application. Similar uses exist in horse track equipment, for sports, camping, backpacks, and military uses. The invention can also be used with round ropes to provide a quick hook.

The spa latches of the invention, while preferably metal such as stainless steel, can also be manufactured from durable plastics (or other metal or ceramic materials) without altering the locking concepts.

Note that in the specification and claims, "about" or "approximately" means within twenty percent (20%) of the numerical amount cited.

Although the invention has been described in detail with particular reference to these embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A latch set comprising:

an elongated receiving portion comprising:

an upper portion with a receiving slot at an angle from a horizontal axis of the receiving portion, and one or more receiving holes on either side of said slot; and a lower portion with one or more attachment holes; and a strap engaging portion comprising:

a strap receiving slot;

a channel going from an edge of said strap engaging portion to said strap receiving slot; and a portion engaging said elongated receiving portion via one or more inward-facing tabs on either side of a central connecting portion and configured to engage said one or more receiving holes.

2. The latch set of claim 1 wherein one or both ends of said elongated receiving portion are rounded.

3. The latch set of claim 2 wherein both ends of said elongated receiving portion are rounded.

4. The latch set of claim 1 wherein said one or more attachment holes number three and are placed in a triangular pattern.

5. The latch set of claim 1 wherein said portion engaging said elongated receiving portion comprises a hole permitting gripping by fingers.

6. The latch set of claim 1 wherein said strap engaging portion comprises one or more additional strap receiving slots.

7. The latch set of claim 6 wherein strap engaging portion comprises two additional strap receiving slots.

8. The latch set of claim 6 wherein said strap engaging portion comprises one or more additional strap receiving slots not having a channel going from an edge of said strap engaging portion thereto.

9. A method of replacing an existing latch set with a latch set according to claim 1, the method comprising the steps of:

removing the existing latch set from a strap;

sliding said strap engaging portion onto the strap via said channel and said strap receiving slot to seat over and above a retainer point of the strap;

inserting said portion engaging said elongated receiving portion into said receiving slot;

rotating said portion engaging said elongated receiving portion to cause said one or more tabs to engage said one or more receiving holes; and attaching said elongated receiving portion to a surface using said one or more attachment holes to provide tension to the strap.

10. The method of claim 9 wherein the existing latch set is for a spa cover.

11. A method of installing a latch set according to claim 6, the method comprising the steps of:

attaching a strap to said strap engaging portion via said channel and said strap receiving slot;

inserting said portion engaging said elongated receiving portion into said receiving slot;

rotating said portion engaging said elongated receiving portion to cause said one or more tabs to engage said one or more receiving holes;

adjusting the strap length via said one or more additional strap receiving slots; and attaching said elongated receiving portion to a surface using said one or more attachment holes to provide tension to the strap.

12. The method of claim 11 wherein the latch set is for a spa cover.

13. The method of claim 11 wherein the steps are repeated for a second latch set.

14. The method of claim 11 wherein the steps are repeated for an opposite end of the strap.

* * * * *